United States Patent [19]

Lamm

[11] 4,432,472

[45] Feb. 21, 1984

[54] SPRAYER ATTACHMENT FOR A FLOOR BUFFING MACHINE

[75] Inventor: George L. Lamm, Melrose, Mass.

[73] Assignee: G & L Manufacturing & Develop. Corp., Melrose, Mass.

[21] Appl. No.: 387,706

[22] Filed: Jun. 11, 1982

[51] Int. Cl.[3] ..... B05B 15/06; A47L 11/40

[52] U.S. Cl. ..... 222/174; 15/50 R; 15/257 R; 222/180; 401/138

[58] Field of Search ..... 15/50–52, 15/98, 320, 257; 222/174, 180; 401/137, 138, 139, 140

[56] References Cited

U.S. PATENT DOCUMENTS

| | | | |
|---|---|---|---|
| 2,591,716 | 4/1952 | Murphy | 222/174 X |
| 3,254,804 | 6/1966 | Grant | 222/174 X |
| 3,490,652 | 1/1970 | Thielen | 222/174 |
| 4,023,711 | 5/1977 | Sena | 222/174 |

FOREIGN PATENT DOCUMENTS

| | | | |
|---|---|---|---|
| 1214506 | 11/1959 | France | 15/50 R |

*Primary Examiner*—Edward L. Roberts

*Attorney, Agent, or Firm*—Wolf, Greenfield & Sacks

[57] ABSTRACT

A remotely actuated, liquid sprayer unit which is configured to be removably mounted onto most commonly used floor buffing machines of almost any size or design and which can be adjusted to direct the spray in the desired direction and at the desired distance. The sprayer unit of this invention includes a container for the liquid, a frame for supporting the container, a spray head which is attached to the container, a mounting assembly for attaching the container frame to a housing of the buffing machine in a desired position, and a chain which runs from the spray head to the handle of the buffer for convenient actuation of the spray head by the user. The length of the chain is adjustable for any size handle, and includes one loop for hooking the chain onto the handle and a second loop adapted to be grasped for actuation of the spray head.

3 Claims, 5 Drawing Figures

SPRAYER ATTACHMENT FOR A FLOOR BUFFING MACHINE

FIELD OF THE INVENTION

This invention relates generally to liquid sprayer units for floor buffing machines and more particularly to remotely actuated, detachable and adjustable sprayer units adapted to fit buffing machines having different configurations.

BACKGROUND OF THE INVENTION

In recent years, floors, especially those in large industrial or institutional settings, have been protected and cleaned using a spray-buff process in which the floor is buffed with a buffer or buffing machine after lightly spraying it with an appropriate liquid solution. The solutions used typically are polymer floor finishes for a dry cleaning process or other spray-buff or cleaning solutions expressly sold for such purposes. Water or a detergent solution may also be used. In early models, a sprayer was hand held and manually actuated to spray selected areas of the floor prior to buffing it with a buffer. Later, more complex sprayer units were manufactured which were secured to the buffer. Most of these units were pressurized with nitrogen or air, and all such sprayer units had a special nozzle in the dispensing head. Often, this nozzle become clogged and considerable time was required to clean the nozzle. Rather than spend the time, many operators would resort to the old hand held sprayers or not spray the floor at all.

More recent models have included non-pressurized sprayer units which are detachable from the buffer for replacement such as the LIQUA-SPRAYER Buffer Attachment manufactured by T.S.S. Manufacturing of Elkhart, Ind. Such models have nozzles which are spaced from the fluid reservoir, thus necessitating the application of the solution to the nozzle by siphoning. In both the pressurized and non-pressurized sprayer units, the position of the nozzle is not readily adjustable either with respect to the machine or with respect to the angle formed between the nozzle and the floor. Additionally, most of such known sprayers cannot be used with all types of buffers.

SUMMARY OF THE INVENTION

This invention relates to a remotely actuated sprayer unit for a floor buffer or buffing machine which is configured to be removably mounted onto buffers of different sizes and shapes and which can be positioned at different locations and orientations on the buffer to allow the spray to be directed in the desired direction and at the desired distance from the sprayer unit. This sprayer unit is comprised of a plurality of readily available parts which permit quick and easy replacement thereof, should one of them become damaged or inoperable, without the replacement of the entire unit.

The sprayer unit of this invention typically includes a container for the liquid to be sprayed, a spray head which is secured to the container and which is manually actuated to expel liquid therefrom, a support frame for the container and an adjustable mounting assembly for securing the support frame to the motor housing of a buffer. A metal chain is removably secured at one end to an actuator handle of the spray head and a first loop at the outer end of the chain may be hooked over the handle of the buffer. A second loop is provided in the chain adjacent the buffer handle for actuation of the sprayer unit and the length of the chain and the size of the second chain loop may be adjusted as desired.

The mounting assembly permits the support frame to be mounted either on the side of the motor housing or on the front thereof for application of spray to the location desired with respect to the buffer. In addition, the container may be rotated about its axis with respect to the support frame for controlling the horizontal angle of the spray, and the support frame may be pivoted with respect to the motor housing to control the vertical angle of the spray to adjust the distance from the buffer at which the spray strikes the floor. In an alternative embodiment, in which the motor housing is disposed to the rear of the buffer, an extended bracket or mount may be provided which is secured at one end to the motor housing and which rests at its other end on top of the buffer housing to position the spray head and container at the forward end of the buffer.

In a preferred embodiment the container is a molded plastic bottle and the spray head is a known trigger actuated pump sprayer which is threadably attached to a neck of the bottle. In an alternative embodiment the container is a pressurized can containing the liquid to be sprayed and the spray head includes a standard aerosol nozzle and a trigger mechanism for depression thereof.

Since this sprayer unit is comprised of readily available parts, its cost is low. The sprayer unit may be affixed to most known floor buffers, and can be moved from floor buffer to floor buffer as needed, so that if a buffer becomes inoperable, the same sprayer unit may be used on another buffer. The spray head has the container attached thereto, so that problems are overcome that are often encountered with prior art units in which the spray head and container are separated and in which pressure or a siphon effect is used to conduct the liquid to the spray head.

DESCRIPTION OF THE DRAWING

The objects, advantages and features of this invention will be more clearly appreciated from the following detailed description taken in conjunction with the accompanying drawing in which.

DETAILED DESCRIPTION OF THE PREFERRED EMBODIMENT

Figure 1:
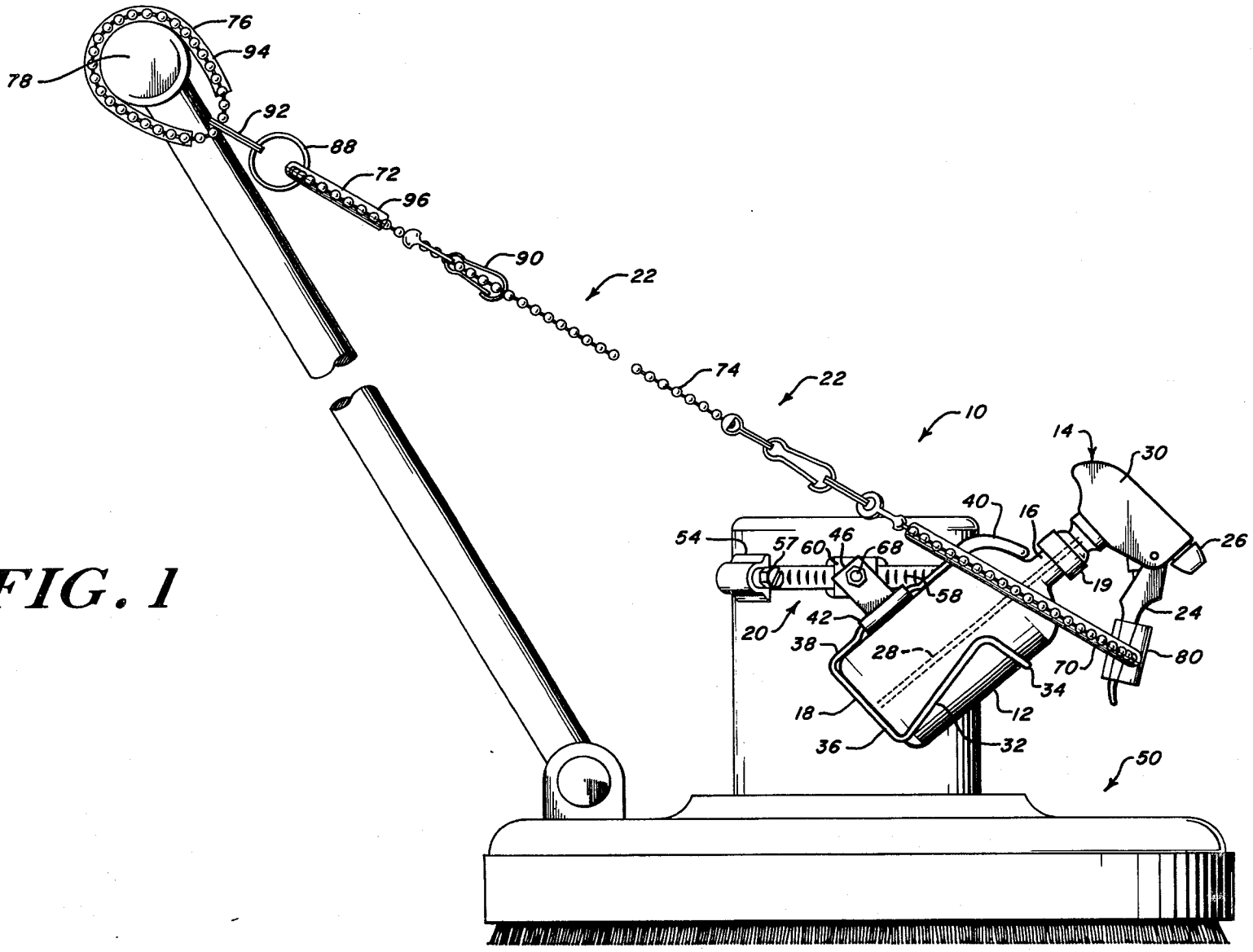
FIG. 1 is a side view of a floor buffing machine having the sprayer unit of this invention mounted thereto in a side position.
Figure 2:
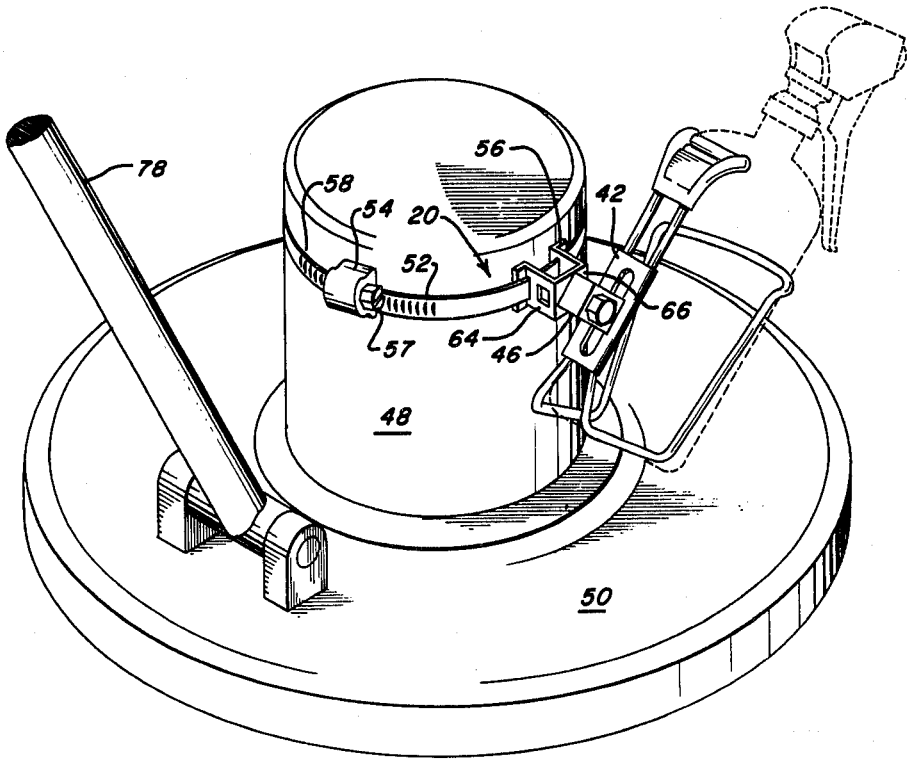
FIG. 2 is a pictorial view of the buffing machine and elements of the sprayer unit of FIG. 1.

With reference now to the drawing, and more particularly to FIGS. 1 and 2 thereof, one embodiment of the sprayer unit 10 of this invention will be described. Unit 10 includes a liquid container 12 for storage and dispensing of a liquid to be sprayed, a liquid sprayer 14, a support frame 18 for supporting container 12, a mounting assembly 20 for securing frame 18 to a housing of a floor buffing machine 50 and an actuating chain 22 for actuation of sprayer 14.

Container 12 is a reservoir for supplying liquid to sprayer 14, and preferably container 12 is a refillable, flexible bottle having a threaded mouth 16 at one end thereof for attachment of sprayer 14. Sprayer 14 may be any commonly known trigger actuated sprayer used to propel a liquid in an aerosol or a stream form. In a preferred embodiment, sprayer 14 is a known pump sprayer which sprays liquid in stream form and which includes a coupling 19 for threadable attachment thereof to mouth 16 of container 12 to permit removal thereof for refilling of container 12. Sprayer 14 also includes a trigger 24 for actuation thereof, a nozzle 26 from which the fluid is expelled, a tube 28 extending to the bottom of container 12 and a pump 30 coupled to trigger 24 for withdrawing liquid from container 12 through tube 28 and expelling it through nozzle 26 upon actuation of trigger 24.

Frame 18 typically is formed of wire configured to conform to the shape of container 12 and it supports container 12 without being secured thereto. Frame 18 includes two arms 32 on a front side of container 12 interconnected by cross support 34, two bottom arms 36 upon which the bottom of container 12 rests and a pair of rear supports 38. Extending from the top of rear supports 38 is a flexible finger 40 which is curved inwardly from supports 38 toward cross support 34. Container 12 may be inserted into frame 18 and removed therefrom by forcing it between finger 40 and cross support 34 to flex finger 40 outwardly away from cross support 34. Finger 40, in its normal, unflexed position presses downwardly against container 12 adjacent mouth 16 to prevent container 12 from easily being forced upwardly and out of frame 18.

Disposed between vertical supports 38 and secured thereto is a bracket 42, and disposed within bracket 42 is a slot 44 elongated parallel to supports 38. A block 46 is mounted to bracket 42 by bolts passing through slot 44, and block 46 has a hole passing therethrough generally normal to the plane of slot 44. The position of block 46 with respect to bracket 42 may be adjusted by loosening the bolts and sliding block 46 along slot 44.

Mounting assembly 20 secures frame 18 and thus sprayer 14 and container 12 to the motor housing 48 of a floor buffer 50 in which housing 48 is generally centrally disposed on buffer 50. Mounting assembly 20 includes band 52, tightening mechanism 54 and mounting bracket 56. Band 52 is a slotted metal band and tightening mechanism 54 is secured adjacent to one end of band 52 while the other end of band 52 passes through mechanism 54 parallel to the one end and spaced therefrom. The circumferential length of band 52 is adjusted by rotation of screw 57 of mechanism 54 whose threads engage the slots 58 in band 52, in a manner known to those skilled in the art. If screw 57 is rotated in one direction, the band is drawn toward mechanism 54 to tighten the band, while if screw 57 is rotated in the opposite direction, the band is pushed away from mechanism 54 to expand the circumferential length of the band. Bracket 56 includes two nearly parallel walls 64 and a wall 66 generally normal thereto and interconnecting one end of walls 64. Disposed at the other end of each wall 64 is a flange 62 which is generally parallel to wall 66 and which extends outwardly away from bracket 56. Flanges 62 are adapted to rest against the outer wall of housing 48, and each wall 64 has a slot 60 adjacent flange 62. Band 52 passes through slots 60 in slidable relation with walls 64 to couple band 52 to bracket 56. Wall 66 and either one or both of walls 64 are each provided with a hole for mounting of block 46 thereto by nut and bolt combination 68.

Figure 3:
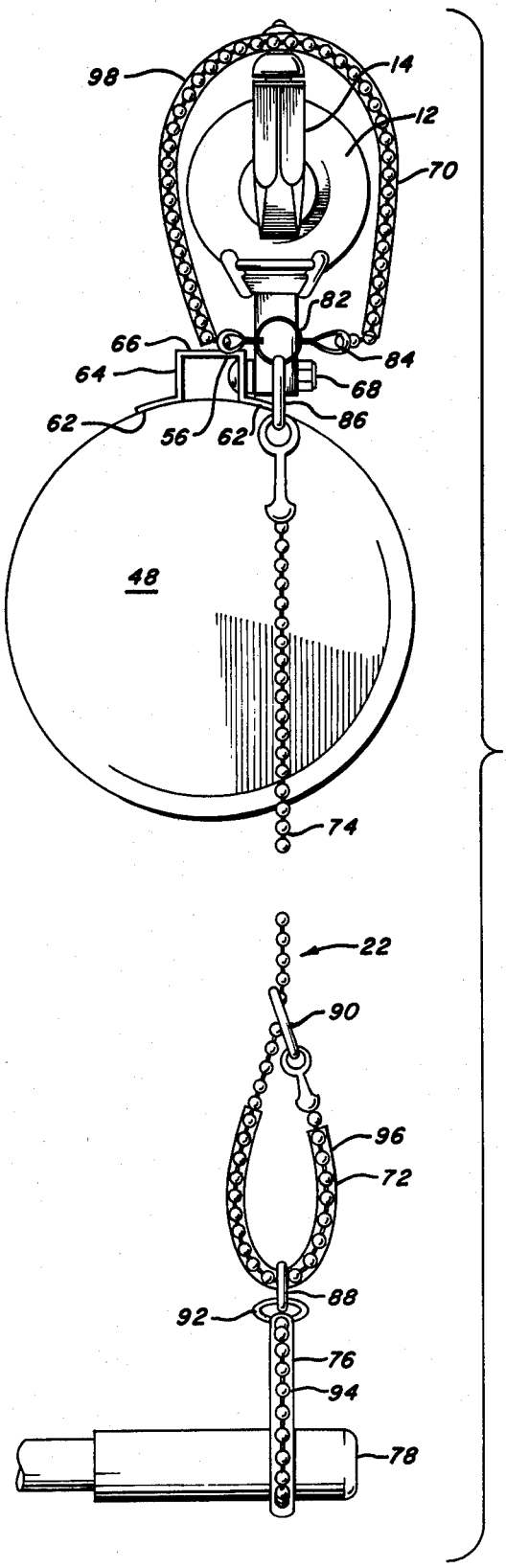
FIG. 3 is a top view of a floor buffing machine showing the sprayer unit of FIG. 1 mounted on a forward position.

Actuation chain 22 will now be described with particular reference to FIGS. 1 and 3. Chain 22 includes a first loop 70 which passes around container 12, a second loop 72 adapted to be grasped by the operator, a third loop 76 adapted to be hooked around a handle 78 of machine 50 and an intermediate segment 74 extending from first loop 70 to second loop 72. First loop 70 passes through a hole in a sleeve 80, and sleeve 80 is adapted to be slid onto trigger 24 of sprayer 14. The ends of loop 70 are interconnected at a ring 82 by couplings 84. Segment 74 is removably attached to ring 82 by a clasp 86, and the other end of segment 74 is looped through a ring 88 and is secured to itself by a clasp 90 to form loop 72. Loop 76 is formed in a manner similar to loop 70 by a length of chain whose ends are connected by couplings 92 at ring 88. The length of segment 74 and thus the circumferential length of loop 72 is adjustable by the positioning of clasp 90 along segment 74. Typically, a plastic sleeve 94 encapsulates the chain of third loop 76, while a sleeve 96 encapsulates the chain of loop 72 and another sleeve 98 encapsulates the chain of loop 70. Sleeve 94 prevents damage to handle 78, while sleeve 96 provides a comfortable grip for the operator, and sleeve 98 prevents damage to container 12 and portions of frame 18 which might otherwise be caused by rubbing of loop 70.

Operation of unit 10 of this invention will now be described with reference to FIGS. 1–3. Unit 10 usually comes in a disassembled condition for attachment to a buffer 50. Bracket 56 is attached to band 52 by passing a free end of band 52 through slots 60, and then the free end of band 52 is inserted into tightening mechanism 54 in a manner known to those skilled in the art. The length of the circumference of band 52 is adjusted by rotation of screw 57 until band 52 is just slightly larger in circumference than housing 48. Band 52 is then placed over housing 48 and bracket 56 is placed in its desired location either by rotation of band 52 or by sliding bracket 56 with respect to band 52. Bracket 56 is positioned either along the side of housing 48, as shown in FIGS. 1 and 2, or at the front of housing 48 as shown in FIG. 3. The positioning of bracket 56 depends upon whether the operator wishes to spray along the side of buffer 50 or directly in front thereof. Band 52 is then tightened by rotation of screw 57 until it is firmly secured to housing 48 and until flanges 62 of bracket 56 are forced against housing 48 to prevent any slippage thereof. If the spray unit is to be mounted to the side of housing 48, as shown in FIGS. 1 and 2, nut and bolt combination 68 is used to secure block 46 to wall 66. If it is desired to mount the unit along the front of housing 48, as shown in FIG. 3, nut and bolt combination 68 is used to secure block 46 to one of walls 64. Block 68 then is secured to bracket 42 by bolts to attach frame 18 to bracket 56.

Once frame 18 is mounted to housing 14, container 12 may be inserted therein merely by bending finger 40 backwardly and forcing container 12 between finger 40 and cross support 34 until container 12 comes to rest on supports 36. Sprayer 14 is then threadably attached to container 12 by means of coupling 19 and mouth 16. Loop 70 is then dropped around sprayer 14 and container 12 from the top, and sleeve 80 is slid over trigger 24. Loop 76 is hooked over handle 78, and the amount of slack in segment 74 and also the size of loop 72 is adjusted by the placement of clasp 70 along segment 74, after handle 78 is pivoted into its operating position. Sprayer unit 10 is now ready for use, and the operator actuates sprayer 14 merely by grasping loop 72 and pulling thereon toward handle 78, to cause loop 70 to pull trigger 24 toward container 12.

The exact location at which spray from nozzle 26 strikes the floor with respect to buffer 50 may be readily controlled by the operator. The range of spray is adjusted by loosening of nut and bolt combination 68 and rotation of frame 18 about nut and bolt combination 68 to provide the desired angular orientation of container 12 with respect to the ground. In addition, the range of the spray may also be controlled by adjusting the location of block 46 with respect to bracket 42. If block 46 resides near the upper end of slot 44 placing container 12 closer to buffer 50, the range is decreased, while if block 46 resides near the lower end of slot 44 raising container 12 to a higher position above buffer 50, the range is increased. Whether the spray is directed toward the side or the front of buffer 50 is controlled by the placement of bracket 56 either along the side of housing 48 or on the front thereof respectively, as described. The angular direction of spray is controlled by rotation of container 12 within bracket 18. Since container 12 is not secured to bracket 18 in any way, it may be rotated to a limited extent, the only limitation being that trigger 24 must be pulled toward container 12 by a tug on chain 22 at loop 72.

Figure 4:
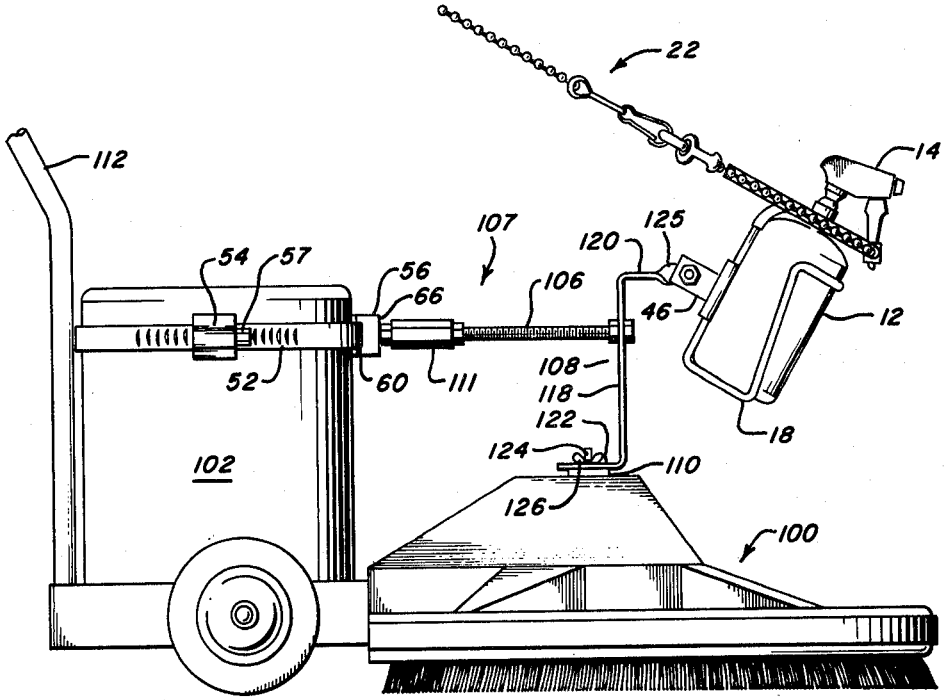
FIG. 4 is a side view of the sprayer unit of this invention showing an alternative embodiment of the mounting assembly.

An alternative embodiment of the mounting assembly for the sprayer unit of this invention will be described with reference to FIG. 4. Mounting assembly 107 of this embodiment secures unit 10 to a buffer 100 which has a motor housing 102 disposed toward the rear thereof. Such buffers tend to be larger and be capable of higher speeds than the buffer 50 illustrated in FIGS. 1–3. Since the embodiment of FIG. 4 differs from that of FIGS. 1–3 only in terms of the mounting assembly, like numbers will be used for like parts where possible. Since container 12, chain 22, sprayer 14, frame 18 and all components associated therewith are identical to those shown in FIGS. 1–3 these elements will not be further described.

Mounting assembly 107 includes slotted metal band 52, bracket 56, threaded arm 106, bracket 108 and mounting plate 110. The circumference of band 52 is adjusted using tightening mechanism 54 and screw 57 as previously described for attachment of band 52 to housing 102. Band 52 passes through slots 60 in bracket 56 as previously described, and bracket 56 is positioned on the front side of housing 102 away from handle 112 of the buffer. Bracket 108 includes a central, generally vertical arm 118, an upper extension 120 and a lower extension 122. Extensions 120 and 122 are generally parallel to one another and extend generally horizontally from central arm 118 at opposite ends thereof. Extension 122 is provided with a hole, and extension 120 has a surface 125 thereof which is generally vertically disposed and normal to central arm 118. One end of arm 106 is secured to wall 66 of bracket 56 by a pair of nuts and a hexagonal coupling 111. The other end of arm 106 extends away from bracket 56 towards the front of the buffer and is secured to central arm 118 by another pair of nuts, and central arm 118 is provided with a plurality of holes so that arm 106 may be secured thereto at any point therealong, depending upon the position of band 52 on housing 102. Surface 125 of extension 120 is secured to block 46 which in turn is secured to frame 18 as previously described. Extension 122 is secured to plate 110 which is attached to buffer 100. Plate 110 is secured to a generally horizontal surface of the enclosure for buffer 100 either by screws or by an adhesive. Plate 110 typically is provided with a screw 124 and a wing nut 126 for attachment of extension 122 thereto. An adhesive surface may be provided on the bottom of plate 110 facing the buffer enclosure for ease of assembly.

Since arm 106 is provided with threads therealong, bracket 108 may be secured to the buffer at any suitable spacing from housing 102. Likewise, the provision of a plurality of holes in arms 118 allows arm 106 to be secured thereto at any suitable height, allowing band 20 to be placed at any desired height on housing 102. Frame 18 may be pivoted with respect to extension 120 to provide sprayer 14 with the desired range while the angular direction of the spray may be controlled by rotation of container 12 within frame 18, all as previously described. The embodiment of FIG. 4 operates and is actuated as previously described by applying tension to chain 22 to depress trigger 24, and its operation will not be discussed further.

Figure 5:
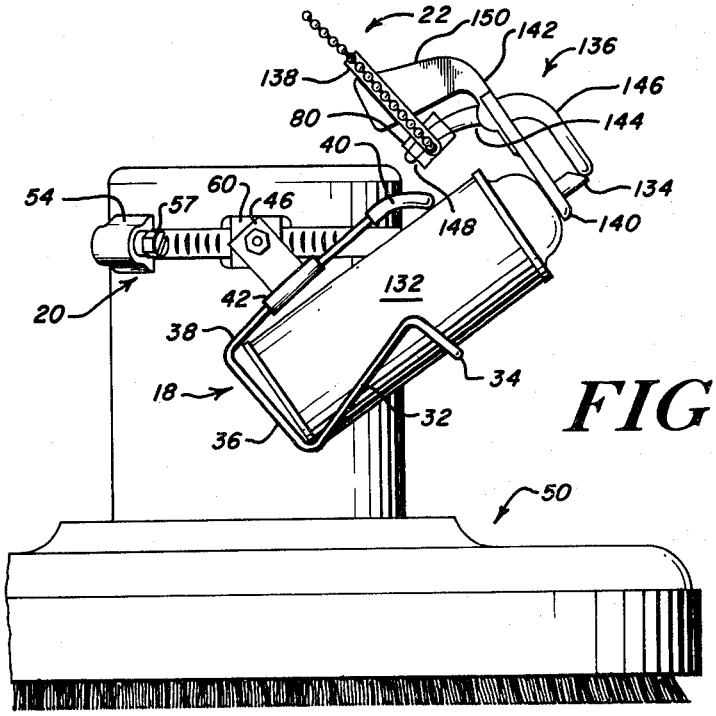
FIG. 5 is a side view of a floor buffing machine having an alternative embodiment of the sprayer unit of this invention mounted thereto in a side position.

An alternative embodiment of container 12 and sprayer 14 is shown in FIG. 5. The same support frame 18, mounting assembly and actuating chain 22 may be used with the embodiment of FIG. 5 as were used for the embodiments of FIGS. 1–3 or the embodiment of FIG. 4. For the sake of clarity, the embodiment of FIG. 5 is shown in conjunction with the mounting assembly 20 of FIGS. 1–3, and like numbers are used for like parts, where possible.

The sprayer unit 130 of FIG. 5 includes a pressurized can 132, a nozzle 134, a trigger mechanism 136 for depression of nozzle 134 and loop 138 on the end of chain 22. Can 132 may be any known pressurized can containing the liquid to be dispensed, and can 132 resides within support frame 18 and is held in place by finger 40 in a manner previously described with respect to container 12. Nozzle 134 is a known aerosol nozzle which sprays the liquid from the can under pressure in an aerosol form upon depression thereof. Trigger mechanism 136 includes a collar 140 which is secured to a lip (not shown) of can 132 surrounding nozzle 134 by a plurality of ears (not shown) which press outwardly against the interior of the lip of can 132. Extending from collar 140 is a handle 142 adapted to be grapsed by an operator, and pivotally mounted in handle 142 and spaced from collar 140 is a trigger 144. Arm 146 of trigger 144 presses down on nozzle 134 to actuate it when curved portion 148 is pulled toward the grip 150 of handle 142. An example of mechanism 136 is the Chesterton Spray Can Handle manufactured by A. W. Chesterton Co., Stoneham, Mass.

Loop 138 encircles grip 150 and portion 148 and passes through sleeve 80. Sleeve 80 is slid over portion 148 to connect chain 22 to mechanism 136. Nozzle 134 is actuated by pulling chain 22 toward the handle of the buffer which pulls portion 148 toward grip 150. This pulling on portion 148 pivots trigger 144 to cause arm 146 to depress nozzle 134 for actuation thereof. The operation of this embodiment is the same as that of the embodiment of FIGS. 1–3 in all other respects.

This invention permits the attachment of the same spray unit to most commonly used floor buffing machines. The embodiment of FIGS. 1–3 allows the attachment of the sprayer unit to a buffer such as the Deluxe model of the floor machine produced by Mastercraft Industries of Newbury, N.Y., while the embodiment of FIG. 4 allows the attachment of a sprayer unit to a buffer such as the Ultra Speed manufactured by General Floorcraft of Bronx, N.Y. The same container and sprayer may be used interchangably with each type of machine and with other similar machines. In addition, since sprayer 14 is screwed onto container 12, should sprayer 14 becomes inoperative or clogged, it may be unscrewed and replaced by another sprayer, without the necessity of replacing the entire unit. The same is true for can 132 and nozzle 134. Also, most other components of this invention are easily removed and can be easily replaced without necessitating replacement of the entire unit. This feature renders the apparatuus of this invention less expensive than prior art units and functionally more dependable. The liquid is contained in close proximity to the sprayer, thus obviating any siphon arrangement. The container is readily removable from frame 18 so that once the liquid has been exhausted, it may be readily replaced with a minimum of lost time. Also, only one unit per operator is necessary, and each buffer need not have its own dedicated unit.

One example of the preferred embodiment of sprayer 14 is the 7600 Trigger Sprayer as produced by Afa of Miami Lakes, Fla. Band 20 is typically metal and may be any such band known to those skilled in the art, while container 12 is typically a molded plastic bottle. Sleeve 80 as well as sleeves 98, 96 and 94 are typically formed of a clear plastic, while chain 22 may be any metal chain known to those skilled in the art.

Modifications and improvements will occur within the scope of this invention and the above description is intended as exemplary only. The scope of this invention is to defined by the following claims and their equivalents.

What is claimed is:

1. A sprayer unit for attachment to a floor buffing machine comprising:

a container for holding a quantity of a liquid to be sprayed and having normally generally vertical side walls;

a manually actuated sprayer head removably attached to said container, said sprayer head having a trigger for actuation thereof and a nozzle for propelling liquid from said container onto a surface to be sprayed;

means surrounding said container for supporting said container, said supporting means having a flexible finger biased against one portion of said side walls of said container to urge an opposite portion of said side walls of said container against a confronting portion of said supporting means to normally retain said container within said supporting means, said finger permitting said container to be inserted and removed from said supporting means by deflection of said finger;

a band having an adjustable circumferential length;

means for adjusting the length of the circumference of said band for tightly securing said band to a housing of a floor buffing machine;

bracket means secured to said metal band and having at least two generally normally disposed surfaces formed thereon, said bracket means being slidable with respect to said band to allow positioning thereof at a selected location on the buffing machine housing;

means for selectively pivotally mounting said supporting means to one of said surfaces of said bracket means; and a chain having one end thereof secured to said trigger of said sprayer head and the other end extending to the handle of the buffing machine for actuating said trigger of said sprayer head.

2. A sprayer unit for attachment to a floor buffing machine comprising:

a container for holding a quantity of liquid to be sprayed;

a manually actuated sprayer head removably secured to said container, said sprayer head having a trigger for actuation thereof and a nozzle for propelling liquid from said container onto a surface to be sprayed;

means for supporting said container and said sprayer head;

a band having an adjustable circumferential length;

means for adjusting the circumferential length of said band to tightly secure said band to a housing of a floor buffing machine;

bracket means slidably disposed on said metal band for positioning thereof at a desired location;

a first arm secured to said bracket means and having an end extending away from the buffing machine housing;

a support arm spaced from the buffing machine housing and disposed generally parallel to vertical surfaces thereof, said support arm being secured to said end of said first arm extending away from the buffing machine housing, said support arm having said supporting means pivotally mounted to an upper end thereof;

mounting means securing said support arm to the buffing machine at a point spaced from the buffing machine housing; and a chain extending from said trigger of said sprayer head to the handle of the buffing machine, tension applied to said chain by an operator at the buffing machine handle causing depression of said trigger and actuation of said sprayer head.

3. A sprayer unit removably attachable to a floor buffing machine having a motor housing, said sprayer unit comprising:

a nonpressurized container for holding a quantity of a liquid to be sprayed and having normally generally vertical side walls;

a manually actuable pump sprayer head secured to said container in communication with the liquid therein, said sprayer head having a trigger for actuation thereof and a nozzle for spraying liquid therefrom in a stream form;

means for supporting said container and said sprayer head;

means for removably securing said supporting means to the motor housing of a floor buffing machine; and a chain extending from a handle of said floor buffing machine to said trigger of said sprayer head for actuating said sprayer head by depression of said trigger, said trigger being disposed on a side of said container opposite of the handle of said floor buffing machine, said chain comprising:

a first loop for generally encircling said container;

means for attaching said first loop to said trigger of said sprayer head;

a second loop for encircling the handle of said floor buffing machine;

a link connecting said first loop to said second loop; and means connected to said link for being grasped for pulling said first loop toward the handle of the buffing machine to depress said trigger of said sprayer head toward a side wall of said container.

* * * * *